US005370105A

United States Patent [19]

Firman

[11] Patent Number: 5,370,105

[45] Date of Patent: Dec. 6, 1994

[54] SQUEEGEE HOLDER

[76] Inventor: David B. Firman, 53B Ctr., Woodbury, N.J. 08096

[21] Appl. No.: 71,056

[22] Filed: Jun. 4, 1993

[51] Int. Cl.[5] ..... F41B 11/00; F41A 29/02

[52] U.S. Cl. ..... 124/56; 42/95; 15/104.05; 15/104.16; 124/1; 124/80

[58] Field of Search ..... 124/56, 80; 42/90, 95; 15/104.05, 104.16, 160, 104.2

[56] References Cited

U.S. PATENT DOCUMENTS

| | | | |
|---|---|---|---|
| 1,333,556 | 3/1920 | Meyer | 42/90 |
| 2,559,376 | 7/1951 | Schnitger | 15/104.05 |
| 4,803,792 | 2/1989 | Brown et al. | 42/95 |
| 4,866,871 | 9/1989 | Rivers | 42/95 |
| 4,875,303 | 10/1989 | DeWeert et al. | 42/90 |
| 5,022,176 | 6/1991 | Frigon et al. | 42/90 |

*Primary Examiner*—Randolph A. Reese
*Assistant Examiner*—John A. Ricci
*Attorney, Agent, or Firm*—Norman E. Lehrer

[57] ABSTRACT

A holder for a paint pellet gun cleaning squeegee, brush or the like which can be secured to the compressed air tank of a paint pellet gun for neatly and securely maintaining the squeegee on the gun body. The holder is comprised of a body member having a cylindrical shape being of a similar contour to that of the cylindrical compressed air tank of the gun. The body member is adapted to be snapped over the tank and securely held thereon. The body member has tubular members integrally attached thereto, one on each side of the contoured portion. The tubular members are closed on one end and open on the other. The open ends of the tubular members are adapted to receive the cleaning brush or the like and hold it therein while the paint pellet gun is being used. If it is desired to clean the barrel of the paint pellet gun, the cleaning brush or the like is removed from the holder and the cleaning is done. In order to avoid unwanted paint soiling of the clothes, instead of placing the brush on the body of the person, the brush is placed into the tubular members of the holder and securely held therein.

9 Claims, 2 Drawing Sheets

SQUEEGEE HOLDER

BACKGROUND OF THE INVENTION

This invention is directed toward a holding device used for holding a gun barrel cleaner and, more particularly, a holding device for holding a paint pellet gun barrel cleaner wherein the holder is adapted to be attached to the compressed air tank of the gun.

Because of the residue remaining in a gun barrel after the firing of the gun, it is necessary to clean the barrel with a cleaning device so as to keep the barrel clean and free from particles which might interfere with the firing of the gun. Many cleaning brushes or the like have been developed for accomplishing this end. It is important that the cleaning device be readily available to the gun bearer so that he may clean the gun when necessary. Accordingly, clip on cleaning devices and the like have been developed for attachment to the gun barrel or, alternatively, holes have been bored into the gun butt for placement of the cleaning device in the gun itself. Similar to real guns and to a greater degree, paint pellet guns also require cleaning.

Paint pellet war, or defending the flag, has become an increasingly popular game wherein paint pellet guns are used as weapons for defending your designated territory. Because the paint pellet ammunition is soft and easily punctured, and due to the occasional misfiring of a paint pellet gun, paint and plastic tends to become lodged in the barrel of the paint pellet guns. The result of such an occurrence is the inability of the participant to defend himself with the gun. Inevitably, if the gun is not cleaned, this malfunction leads to the figurative death of the disarmed participant. Therefore, it has become desirable in such games to carry upon one's person a means for cleaning the paint pellet gun barrel during battle.

There exists elongated swabs, brushes or squeegees which are very effective in cleansing the gun barrel so that the paint pellet gun becomes functional again and thus allows the participant to further engage in battle and defend his flag. However, because the game deals with paint, the brush, squeegee or swab becomes very messy. The current practice is to place the paint-soiled brush or the like in one's pocket or belt strap. However, this tends to stain the participant's clothing with paint thereby making a mess. Also, based on the rules of the game, a participant is disqualified from play in a particular war game if fresh paint is found on any portion of his body and was caused by the fire of the opponent. Because of the confusing nature of the battles, paint upon the clothing from a paint-soaked brush or swab can be mistaken to be a hit by the opponent. Therefore, it would be preferable to store the brush or swab in a manner which does not expose the participant to paint-soaked clothes not caused by the opponent.

While the prior art discloses methods and apparatuses for the storage of gun barrel cleaning implements, none discloses the particular structure and advantages of the holding device of the instant invention. As is evident in the following, no prior art discloses a squeegee, brush or swab holder for use with paint ball guns.

U.S. Pat. No. 2,744,275 to Geltner, for example, discloses a maintenance kit for fire arms. As shown in FIG. 6 of the patent, the maintenance kit is adapted to be stored in the handle or butt of a rifle so that it may be easily accessible to the gun bearer during use of the gun. However, as can be seen, there is no separable attachment capable of storing a cleaner for use with a paint ball gun or any gun to which the present invention may be directed.

U.S. Pat. No. 464,099 to Wehrstedt discloses a cleaning rod for fire arms. As shown in FIG. 1 of that patent, the cleaning rod is attachable to the barrel of the rifle or fire arm by being placed into a hole in the same. Similar to Geltner, however, no separable means is disclosed by which a cleaning device for use with a paint ball gun may be stored.

U.S. Pat. No. 4,399,627 to Malesky et al. discloses a flexible cleaning device having a storage case. The cleaning device is adapted to be used for cleaning a gun barrel and can be stored in the storage case as shown. However, there are no means disclosed for attaching the storage case to the gun, nor is the device even directed towards paint ball gun applications.

In addition to the foregoing, U.S. Pat. Nos. 2,800,289, 4,866,871, 4,875,303 and 5,022,176 all disclose apparatuses for cleaning gun barrels or the like, some of which have holding cases for the same. However, none of the devices is directed toward paint ball gun applications nor do any of the devices have separable means for attachment of the cleaning device to a portion of the gun wherein the attachment device is removable from the gun.

SUMMARY OF THE INVENTION

This invention is a holder for use with a paint ball gun barrel cleaner wherein the holder is attachable to the paint gun and readily capable of receiving a cleaning brush, swab or squeegee. The holder allows a paint gun war game participant to conveniently hold and carry the barrel cleaner with him in a clean and secure manner.

The holder is comprised of a main body member which attaches to the compressed air tank of a paint ball gun. The main body member is substantially a half-cylinder having a contour substantially similar in size and shape to the outer surface of the compressed air tank. The main body member has tubular members located adjacent thereto and attached on each side. The tubular members are of substantially smaller diameter than the main body member and are used for receiving the ends of the cleaning brush, swab or squeegee. The tubular members have one open end and one closed end and the swab or the like can be placed into the tubular member by forming the same into a U-shape and placing the ends into the tubular members in a parallel manner. The main body member has a circumference which is slightly more than a half-cylinder and is formed from a flexible material so that it can be opened up and placed onto the compressed air tank and secured thereto.

The holder is used by simply opening the main body portion slightly and placing it onto the compressed air tank. Upon placement of the holder, the flexible nature of the body will draw it back to its original shape thereby securing it to the cylindrically-shaped tank. With the holder in place, a cleaning swab or brush or the like is placed into the tubular members by bending the brush into a U-shaped formation and placing the ends of the brush into the open ends of the tubular members in a parallel manner. As such, the war game participant may carry the barrel cleaner with him in a neat and secure manner.

BRIEF DESCRIPTION OF THE DRAWING

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
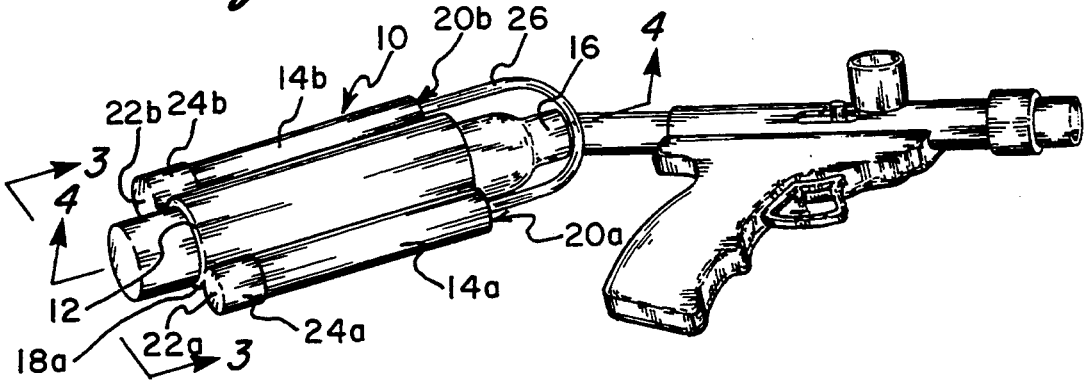
FIG. 1 is a side perspective view of the holder of the present invention in place on the compressed air tank of a paint ball gun and having a cleaning squeegee therein.

Referring now to the drawings in detail, wherein like reference numerals are used throughout the various figures to designate like elements, there is shown in FIG. 1 a paint ball gun and compressed air tank having the holding device attached thereto and designated generally as 10. The holding device 10 is comprised of the contoured center portion 12 and the tubular members 14*a* and 14*b* attached thereto.

Figure 6:
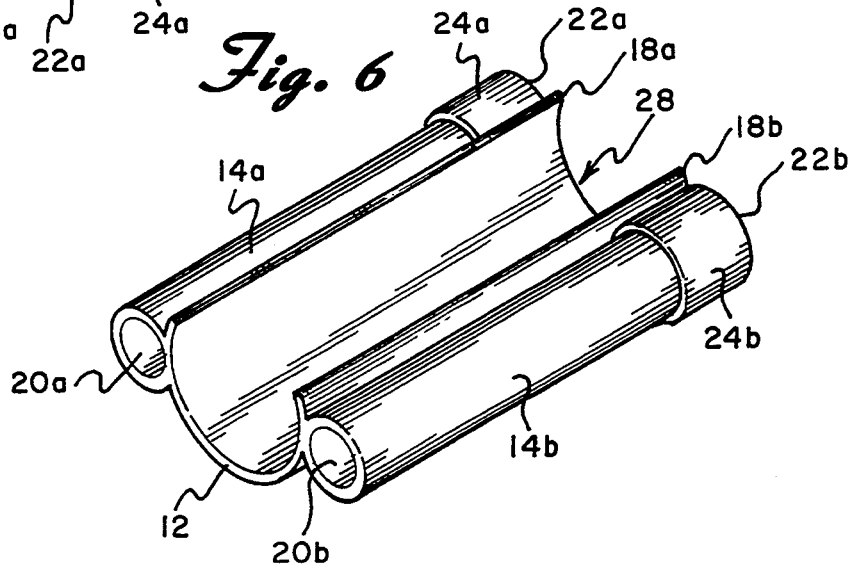
FIG. 6 is a bottom perspective view of the holder.

The main body portion of the holder 10 is comprised of the contoured portion 12. The contoured portion 12 has a C-shaped cross-section which is slightly larger than a half-cylinder so as to allow the securing of the holder 10 onto the compressed air tank 16. The holder 10 is formed from a flexible but rigid material, preferably plastic, so that the contoured portion may be flexed outwardly for opening the same for placing it onto the tank 16. As shown in FIG. 6, the contoured portion 12 has edges 18*a* and 18*b* which extend beyond the point where the contoured portion 12 would be a half-cylinder. As such, the contoured portion does not fit directly onto the tank 16 without first opening it. After opening the holder 10 and placing it over the tank 16, the contoured portion 12 returns to its original shape thereby securing the holder to the tank.

Figure 4:
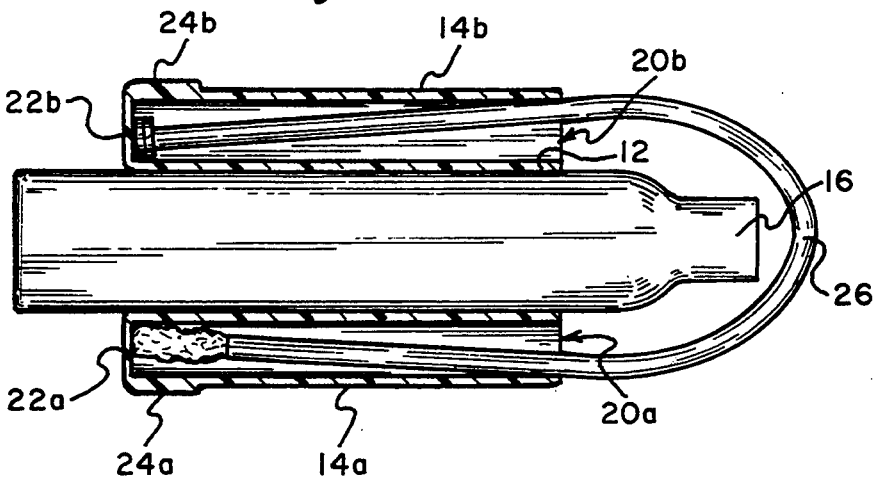
FIG. 4 is a cross-sectional view taken along line 4—4 of FIG. 1.
Figure 5:
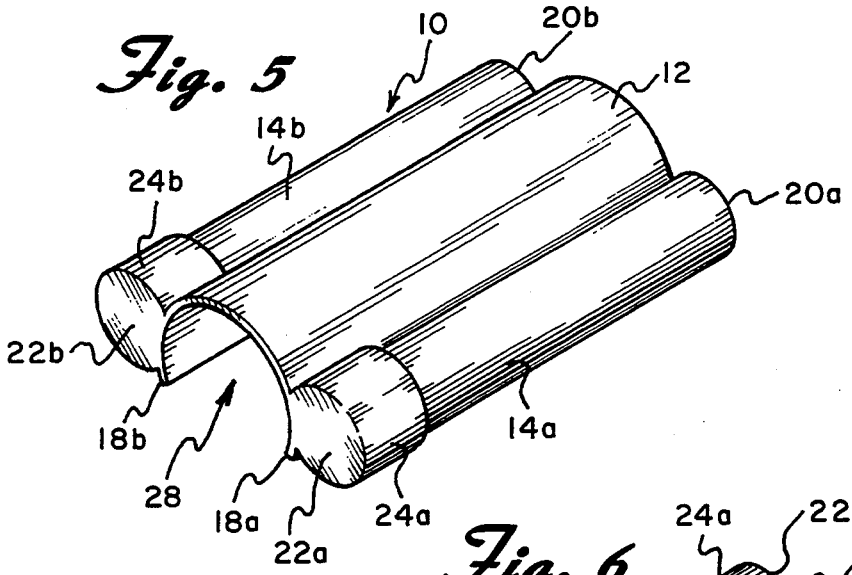
FIG. 5 is a top perspective view of the holder.

The tubular members 14*a* and 14*b* are integrally attached to the contoured portion 12 preferably by molding all elements simultaneously. However, they may be separately formed and attached to the contoured portion at a later time. As shown in FIGS. 5 and 6, the tubular members 14*a* and 14*b* are attached to the contoured portion 12 at the point where the extensions 18*a* and 18*b* extend the contoured portion 12 beyond the shape of a half-cylinder so that they are substantially centered on the tank 16. The tubular members 14*a* and 14*b* are substantially cylindrical in shape having open ends 20*a* and 20*b* and closed ends 22*a* and 22*b*. The tubular members 14*a* and 14*b* have caps 24*a* and 24*b* secured to the ends 22*a* and 22*b*, respectively, so as to provide closures for the ends. As shown in FIG. 4, the tubular members 14*a* and 14*b* are adapted to receive a cleaning swab, brush or squeegee 26. As is also shown in FIG. 4, the cleaning member 26 is flexible and can be bent into a U-shape so that each end of the member can be placed into one of the open ends 20*a* and 20*b* of the holder 10.

Figure 2:
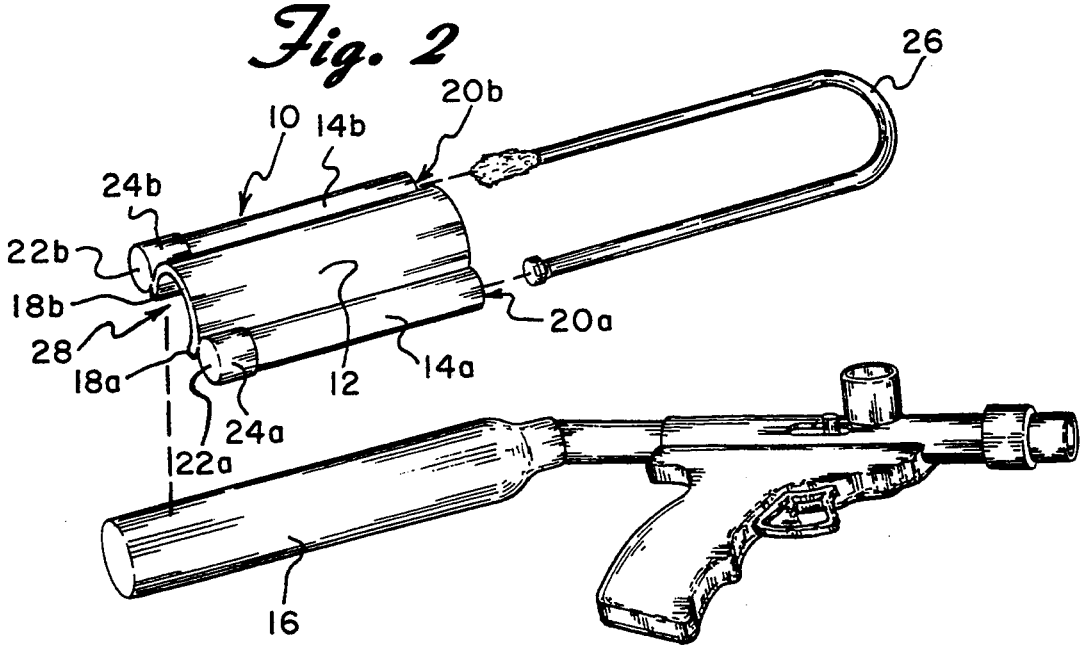
FIG. 2 is an exploded perspective view showing the assembly of the holder onto the compressed air tank and the placement of the cleaning device into the holder.
Figure 3:
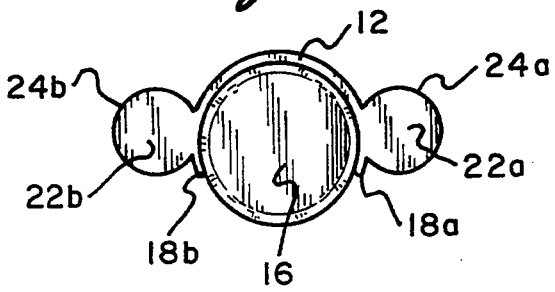
FIG. 3 is an end view of the holder on the tank taken along line 3—3 of FIG. 1.

The holder is used, as shown in FIG. 2, by forcing the holder 10 onto the tank 16. This is accomplished by pressing the open side 28 over the tank 16 until the contoured portion 12 envelopes the tank 16. Upon proper placement, as shown in FIG. 1, the cleaning brush 26 is bent into a U-shaped formation and each end of the brush is placed into an open end 20*a* or 20*b* such that the cleaning brush 26 securely rests in the holder 10 as shown in FIG. 4. In order to use the brush again, the brush 26 is simply pulled out of the holder and tubular members 14*a* and 14*b*, straightened, and used in the normal fashion. When the cleaning process is done and the brush, swab or squeegee is soiled with paint, instead of placing the cleaning member upon the person's body, it may be placed into the holder as shown in FIGS. 1 and 4. As such, undesired soaking of the clothing with paint is avoided. The holder 10 can, of course, be removed and cleaned when desired.

The present invention may be embodied in other specific forms without departing from the spirit or essential attributes thereof and accordingly reference should be made to the appended claims rather than to the foregoing specification as indicating the scope of the invention.

What is claimed is:

1. A holder for a gun barrel cleaning device comprising a body member adapted to engage an extending member of a gun, said body member having a contoured portion being similar in shape to said extending member, said contoured portion being adapted to partially envelope said extending member and having engagement means for securely attaching said body member to said extending member, said body portion further comprising storage means positioned adjacent said contoured portion for holding said cleaning device, said storage means comprising a pair of tubular members, one located on each side of said contoured portion, each of said tubular members having a closed end and an open end, said open ends being adapted to receive the ends of said cleaning device.

2. The invention according to claim 1 wherein said engagement means comprises said contoured portion having a contact surface extending slightly beyond the halfway point of the cross section of said extending member, said contoured section being flexible for allowing for the opening thereof for placement around said extending member, said contact surface closely approximating the outer shape of said extending member.

3. The invention according to claim 2 wherein said contoured portion has a shape slightly larger than a half-cylinder for engaging said extending member having a circular cross section.

4. The invention according to claim 2 wherein said holder is adapted to be attached to a compressed air tank of a paint pellet gun.

5. A holder for a gun barrel cleaning device comprising attachment means for attaching said holder to an elongated portion of a gun and a pair of tubular members adapted to receive the ends of said cleaning device, one of said tubular members being positioned on each side of said attachment means, each of said tubular members having a closed end and an open end, said open ends being adapted to receive the ends of said cleaning device.

6. The invention according to claim 5 wherein said elongated portion has a symmetrical surface cross section comprised of two similarly shaped and sized halves, said attachment means comprising an elongated member having a contact surface with a cross section similar in size and shape to a perimeter section of said elongated portion, said perimeter section being defined by the cross section of the surface of one of said halves plus the cross section of a segment of the surface of the other half.

7. The invention according to claim 6 wherein said surface cross section of said portion is circular, said contact surface having a cross section slightly larger than a half circle.

8. The invention according to claim 7 wherein said elongated portion is a compressed air tank of a paint pellet gun, said holder adapted to be attached thereto.

9. The invention according to claim 6 wherein said holder is formed from a semi-rigid but flexible material wherein said contact surface of said holder must be deformed outwardly for fitting said holder over said elongated portion.

* * * * *